US006890971B2

(12) United States Patent
Paris et al.

(10) Patent No.: US 6,890,971 B2
(45) Date of Patent: May 10, 2005

(54) METHOD FOR MAKING RADIATION ABSORBING MATERIAL (RAM) AND DEVICES INCLUDING SAME

(75) Inventors: Henry G. Paris, Chattanooga, TN (US); Danny R. Smith, Chattanooga, TN (US); Scott F. Smith, Hixson, TN (US)

(73) Assignee: Steward Advanced Materials, Inc., Chattanooga, TN (US)

( * ) Notice: Subject to any disclaimer, the term of this patent is extended or adjusted under 35 U.S.C. 154(b) by 17 days.

(21) Appl. No.: 10/189,654

(22) Filed: Jul. 3, 2002

(65) Prior Publication Data

US 2003/0008131 A1 Jan. 9, 2003

Related U.S. Application Data

(60) Provisional application No. 60/302,768, filed on Jul. 3, 2001.

(51) Int. Cl.[7] ..... G21F 1/10

(52) U.S. Cl. ..... 523/137; 252/513; 428/404

(58) Field of Search ..... 428/328, 331

(56) References Cited

U.S. PATENT DOCUMENTS 5,866,273 A 2/1999 Wiggins et al. ..... 428/611
5,990,417 A 11/1999 Senda et al. ..... 174/35
6,063,511 A 5/2000 Purinton et al. ..... 428/692
6,309,620 B1 10/2001 Schlegel et al. ..... 423/326
6,379,804 B1 * 4/2002 Ackerman et al. ..... 428/433

OTHER PUBLICATIONS

Patent Abstracts of Japan, vol. 017, No. 443 (M–1463) Aug. 16, 1993; JP 05 098301A (Hitachi Metals Ltd.) abstract.

Patent Abstracts of Japan, vol. 016, No. 129 (M–1228) Apr. 2, 1992; JP 03 291306A (Tokin Corp.) abstract.

* cited by examiner

*Primary Examiner*—Monique R. Jackson
(74) *Attorney, Agent, or Firm*—Allen, Dyer, Doppelt, Milbrath & Gilchrist, P.A.

(57) ABSTRACT

A method for making a radiation absorbing material (RAM) coating may include providing an iron-silicon alloy powder, forming the iron-silicon alloy powder into flakes, and passivating the flakes. The method may further include selecting passivated flakes having a desired size, and combining the selected passivated flakes with a carrier to provide the RAM coating. The coating may be applied to a substrate to impart the radiation absorbing property thereto.

34 Claims, 4 Drawing Sheets

METHOD FOR MAKING RADIATION ABSORBING MATERIAL (RAM) AND DEVICES INCLUDING SAME

CROSS-REFERENCE TO RELATED APPLICATIONS

This application claims the benefit of U.S. Provisional Application No. 60/302,768, filed Jul. 3, 2001, which is hereby incorporated herein in its entirety by reference.

FIELD OF THE INVENTION

The present invention relates to energy absorbing materials, and, more particularly, to electromagnetic energy absorbing materials and related manufacturing methods.

BACKGROUND OF THE INVENTION

Radiation absorbing materials (RAMs) are used in a variety of applications where it is desirable to absorb, rather than reflect, electromagnetic (EM) radiation. For example, RAMs are sometimes used in coatings for cables, antennas, or other devices to shield these devices from noise which would otherwise result from the reflection of EM radiation. Another particularly advantageous application for RAM coatings is on vehicles such as airplanes to make them less susceptible to detection by radar.

The absorption properties of RAM coatings are typically the result of a ferromagnetic material included therein. More particularly, two widely used ferromagnetic materials in RAM applications are carbonyl iron and ferrous silicide. Although both materials have been supplied in fine spherical powders capable of being compounded with elastomers for application, have similar densities, and are approximately equivalent in their energy absorbing capabilities, ferrous silicide has greater corrosion resistant properties and is more thermally stable. In particular, carbonyl iron is subject to oxidation (i.e., rusting), which may not only cause magnetic degradation but also an undesirable discoloration of the coating.

One example of a ferrous silicide RAM coating is disclosed in U.S. Pat. No. 5,866,273 to Wiggins et al. This patent is directed to a method for making an iron-silicon compound powder that includes blending magnetic materials such as carbonyl iron, iron cobalt, and/or nickel and very pure silicon powders with an activator, such as a halide salt, and then heating the mixture between 1350° F. and 1600° F. in an inert atmosphere. The result is then ground until it passes through a 200 mesh screen. The powder so formed is then heated in air to form a thin protective shell about each particle of the powder. Thereafter, the powder can be combined with a suitable binder to form a RAM coating. Each of the resulting particles in the powder has a generally spherical shape.

Unfortunately, methods such as the one described above for forming ferrous silicide compounds suitable for high temperature and/or highly corrosive environments have heretofore been very energy intensive. Such methods are also typically subject to low yields. As such, the production of ferrous silicide using such methods is, generally speaking, relatively costly. In addition, coatings produced using spherical particles may be relatively heavy. Further, because of the phenomena of skin depth, only a small portion of surface area is active in attenuating EM radiation in such coatings due to the spherical nature of the ferrous silicide particles.

SUMMARY OF THE INVENTION

In view of the foregoing background, it is therefore an object of the present invention to provide a method for economically making radiation absorbing materials (RAMs) and coatings which provide desired radiation absorption.

This and other objects, features, and advantages in accordance with the present invention are provided by a method for making a RAM coating which may include providing an iron-silicon alloy powder, forming the iron-silicon alloy powder into flakes, and passivating the flakes. The method may further include selecting passivated flakes having a desired size, and combining the selected passivated flakes with a carrier to provide the RAM coating. In some embodiments, other passivated particle shapes may also be included in the coating.

By using passivated flakes, the resulting RAM flakes may be arranged within the coating to yield greater performance with a reduced amount of material (and, thus, weight). Moreover, flaked particles have a lower settling rate than spherical particles of similar size and may thus provide a more uniform coating. Plus, the use of flakes increases the ratio of surface area to volume, thus creating more useful attenuation per unit mass than with prior art ferrous silicide coatings.

More particularly, the iron-silicon alloy powder may be melt sprayed iron-silicon alloy powder or diffused iron-silicon alloy powder, and have less than about 25% silicon by weight, for example. The flakes may be formed by impact milling the iron-silicon alloy powder, grinding the iron-silicon alloy powder using a dry attritor, and/or wet milling the iron-silicon alloy powder in the presence of a solvent, for example. In the latter case, one exemplary solvent which may be used is heptane, and the method may also include removing the solvent prior to passivating.

Selecting the passivated flakes having the desired size may include deagglomerating the passivated alloy flakes and screening the deagglomerated flakes to obtain flakes having the desired size. By way of example, the desired size may be a maximum dimension in a range of less than about 60 microns. The passivation may include exposing the flakes to an oxygen containing ambient at a temperature of less than about 700° C., and for less than about 24 hours. Additionally, the carrier may include at least one of an organic material, a dielectric material, an electrically conductive material, a magnetic material, and an elastomeric material. In some embodiments, passivated, generally spherical iron-silicon alloy particles may also be combined with the passivated flakes and carrier to provide the RAM coating.

Another aspect of the invention relates to a radiation absorbing device which may include a substrate and a radiation absorbing material (RAM) coating on the substrate. More particularly, the RAM coating may include a carrier and passivated iron-silicon alloy flakes in the carrier, as briefly described above. In particular, the passivated iron-silicon alloy flakes may include an outer $SiO_2$ layer. Additionally, the passivated iron-silicon alloy flakes may include less than about 25% silicon by weight, as well as less than about 25% $Fe_5Si_3$ by weight. The passivated iron-silicon alloy flakes may also advantageously include greater than about 40% $Fe_3Si$ by weight and about 0.5–25% FeSi by weight.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
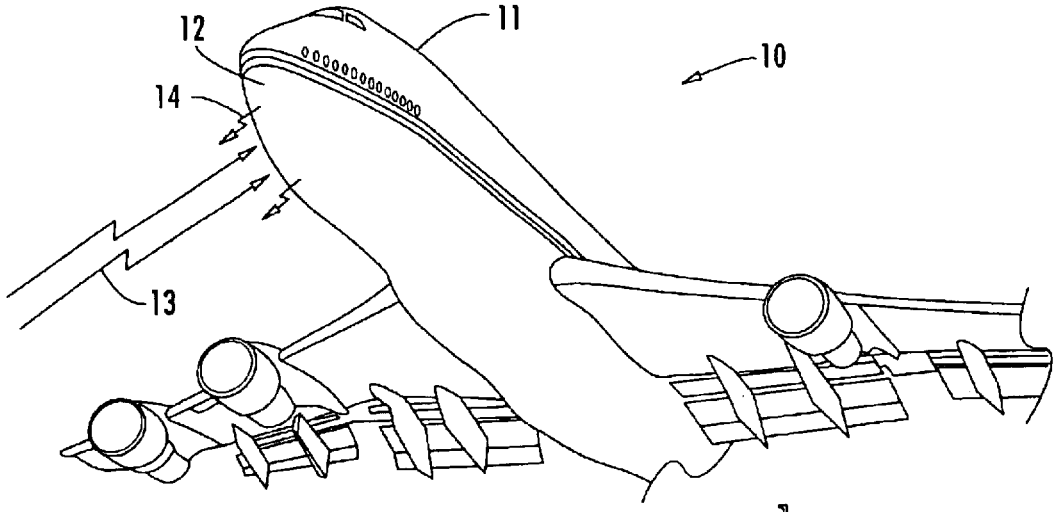
FIG. 1 is a perspective view of a portion of an aircraft having a radiation absorbing material (RAM) coating thereon in accordance with the present invention.
Figure 2:
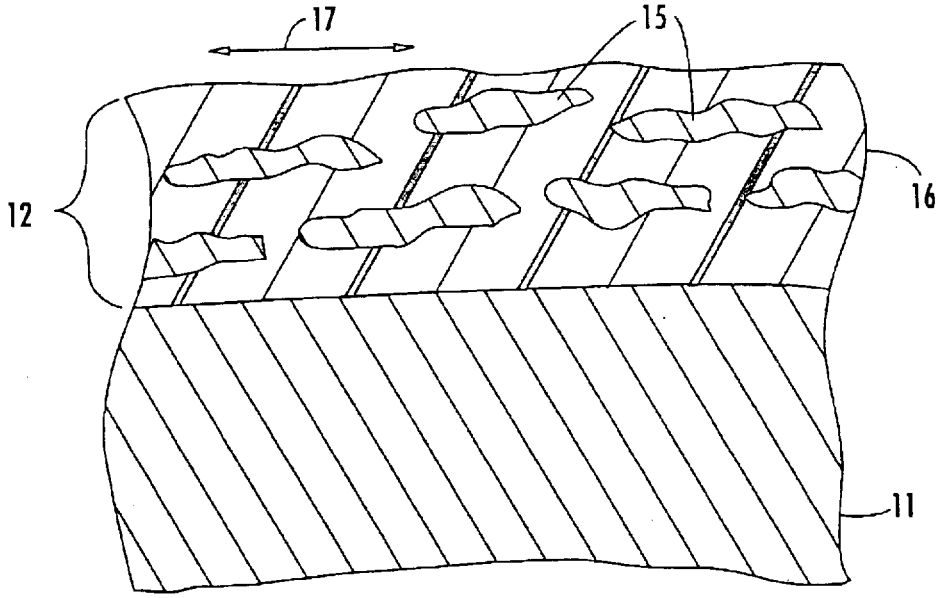
FIG. 2 is a cross-sectional view of a portion of a wing of the aircraft of FIG. 1.

Referring initially to FIGS. 1 and 2, a radiation absorbing device in the form of an aircraft 10 in accordance with the present invention is first described. The radiation absorbing device includes a substrate, which in the illustrated example is the airframe 11 of an airplane 10, and a radiation absorbing material (RAM) coating 12 on the substrate. The RAM coating is for absorbing EM radiation incident on the airframe 11, such as radar or other radio frequency (RF) signals, which are illustratively shown by the large arrows 13 in FIG. 1.

As a result of the RAM coating 12, the amount of EM energy reflected by the airframe 11 will be substantially reduced, as illustrated by the small arrows 14. Thus, the airframe 11 will be more difficult to detect using radar. Of course, those skilled in the art will appreciate that numerous substrates other than airframes (e.g., cables, antennas, etc.) may also advantageously be coated with the RAM coating 12 in accordance with the invention to provide desired EM absorption.

Figure 3:
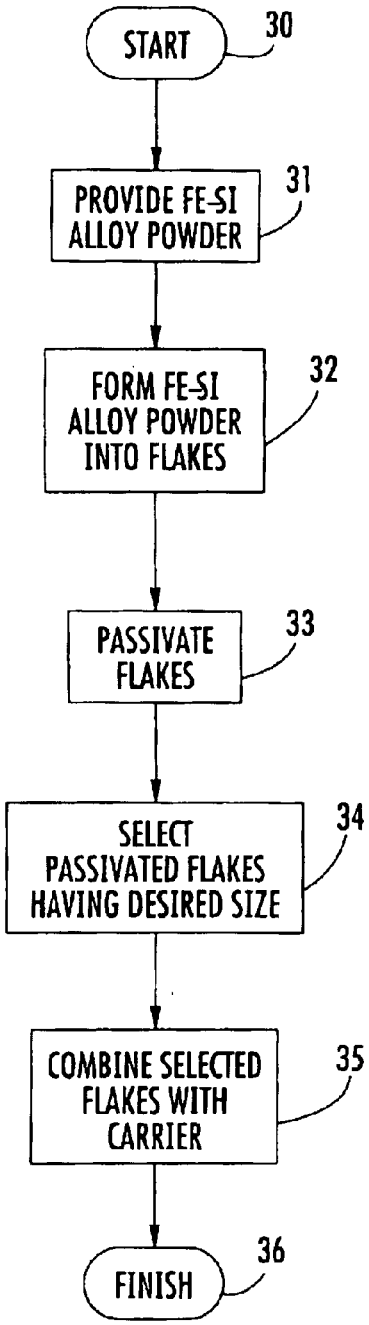
FIG. 3 is a flow diagram illustrating a method for making a RAM coating in accordance with the present invention.

Turning now additionally to FIG. 3, a method for making the RAM coating 12 in accordance with the invention will now generally be described. The method begins (Block 30) by providing an iron-silicon alloy powder for processing, at Block 31. Most prior art methods for alloying iron and silicon typically include the compounding of the two powders, adding an activator or catalyst, then sintering the mixture in an electric furnace with an inert atmosphere. By using the catalyst, this reaction becomes exothermic and proceeds quite rapidly at elevated temperatures. This rather violent reaction makes control of the temperature difficult throughout the entire mass of the material As a result of the above condition, and coupled with some inhomogeneities in the mixture, this reaction produces more variation in the ferrous silicide phases present than is typically desired. That is, as many as five separate phases may be produced during the alloying process, namely $Fe_3Si$, $Fe_{11}Si_5$, $Fe_2Si$, $Fe_5Si_3$ and FeSi. Of these, from the standpoint of developing a RAM material, the $\alpha$ or $Fe_3Si$ is the most desirable. As a result, the alloying reaction is preferably controlled to favor this phase and limit the $Fe_{11}Si_5$, $Fe_2Si$, and $Fe_5Si_3$ phases. The FeSi phase, which is the equilibrium partner of the $Fe_3Si$ phase, is not as desirable as $Fe_3Si$ in terms of EM absorption, but it also does not have relatively low Curie temperatures as do the $Fe_{11}Si_5$, $Fe_2Si$, and $Fe_5Si_3$ phases. Accordingly, the FeSi phase is less likely to affect performance at high temperatures, and thus having some FeSi in the starting powder and/or final product is typically not problematic.

Along with the necessary magnetic characteristics, the RAM powder that is ultimately produced should also have temperature stability and corrosion resistance. The $\alpha$ phase has a very high Curie temperature (greater than 500° C.), as will be appreciated by those of skill in the art, and when the alloy is further processed may develop high corrosion resistance. It will further be appreciated that the effect of composition and temperature may have a significant impact on the phases present.

Accordingly, it is desirable that the solid state diffusion reaction be carried out such that the iron and silicon alloy in the proper phase ratio to provide the proper starting percentages thereof. Of course, this requires that the reaction temperature be maintained in the necessary range, but this does not always happen as desired due to the rapid and violent reaction rate noted above. As a result, a fused cake, which includes several phases, is often produced using typical prior art approaches. Thus, this fused cake requires reduction to powder and air classification before proceeding with the formation of the corrosion resistant RAM. Yet, the cake is typically very hard and abrasive. Plus, not only is it expensive to reduce the size thereof, but a considerable quantity of undesirable phases may be present in the resulting powder.

Moreover, in selecting an alloy for use in making RAMs, those of skill in the art will appreciate that it is important to achieve not only reasonably high magnetic moment and high Curie temperature but also to provide high corrosion resistance. The first two characteristics are maximized in the a or $Fe_3Si$ phase. However, this phase is not as resistant to corrosion as are higher percent silicon phases. A balance should thus preferably be achieved in the formulation of the alloy to yield the most optimum properties for reflection or attenuation of radar or other EM radiation, and to perform at temperatures significantly above ambient. That is, the $Fe_3Si$ phase is preferably favored while the $Fe_{11}Si_5$, $Fe_2Si$, $Fe_5Si_3$ phases are preferably limited, as noted above, though complete removal of these low temperature Curie phases may not always be possible or practical.

Accordingly, during the formation of the iron-silicon alloy powder, rapid cooling from the melt may be used to not only promote homogeneity but also control temperatures and thus increase the presence of the desired phase(s). For these and other reasons, an iron-silicon alloy powder produced using processes based on melt spraying may be used as the starting or "raw" material for making RAM and RAM coatings in accordance with the present invention.

In particular, one such melt-sprayed iron-silicon alloy powder which has been found to provide desired results is manufactured by Hoeganaes Inc. of Cinnaminson, N.J. In conjunction with Steward, Inc., assignee of the present application, Hoeganaes developed the above composition to include a desired iron-silicon ratio. That is, the percent silicon by weight in this composition is less than about 25%, and, more particularly, in a range of about 17 to 22%.

The above ratio has been found to achieve high resistance to corrosion as well as equivalent or better performance with respect to ferrous silicide that is produced by diffusion reaction, or from carbonyl iron powder. Moreover, the above-described powder may be supplied in a relatively fine powder through Hoeganaes' melt-spraying process. By way of example, typical particle sizes (which are generally spherical) for the powder are typically in a range of about 15 to 40 microns.

Yet, those of skill in the art will appreciate that iron-silicon alloy powders produced in accordance with other methods may also be used in certain applications. By way of example, iron-silicon alloys may also be formed by diffusion processes. That is, iron and silicon may be heated in an atmosphere kiln to form the base alloy. Then, coarse particles may be formed by processing the base alloy in an impact mill/air classifier, for example, and then further refined with the impact mill/air classifier to provide a power with suitable particle size. Here again, spherical particles are produced which preferably have a particle size in the 7 to 40 micron range.

Referring once again to FIG. 3, the method further includes forming the iron-silicon alloy powder into flakes, at Block 32, and passivating the flakes, at Block 33, both of which will be discussed further below. By using flakes, the resulting RAM may be arranged within the coating 12 to yield greater performance with a reduced amount of material (and, thus, weight). Moreover, flaked particles have a lower settling rate than spherical particles of similar size and may thus provide a more uniform coating than with prior art powders having generally spherical particles, for example. Further, passivation of the flakes 15 (FIG. 2) provides a layer of oxidation (i.e., $SiO_2$) (not shown) which increases corrosion resistance. The method may further include selecting passivated flakes 15 having a desired size, at Block 34, and combining the selected passivated flakes with a carrier 16 to provide the RAM coating, at Block 35, thus completing the method (Block 36).

Figure 4:
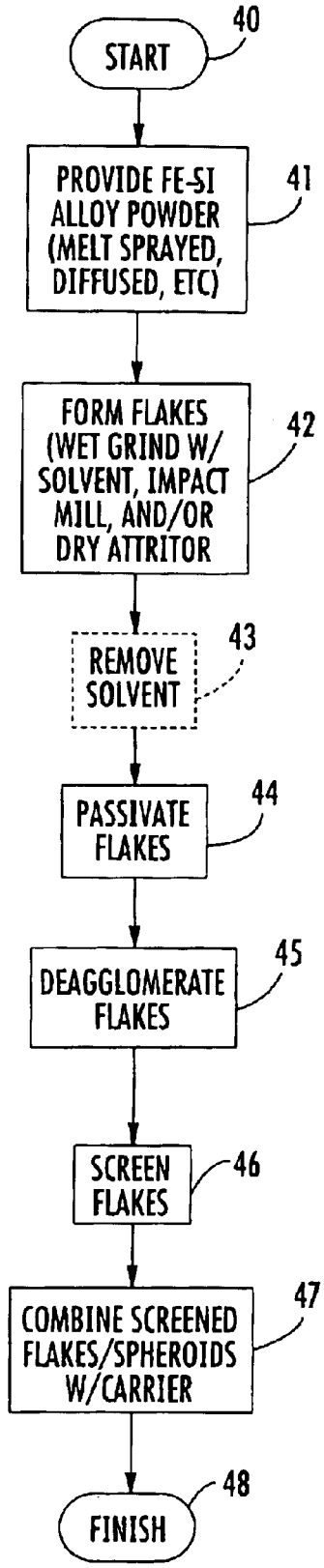
FIG. 4 is flow diagram illustrating the method of FIG. 3 in greater detail.
Figure 5:
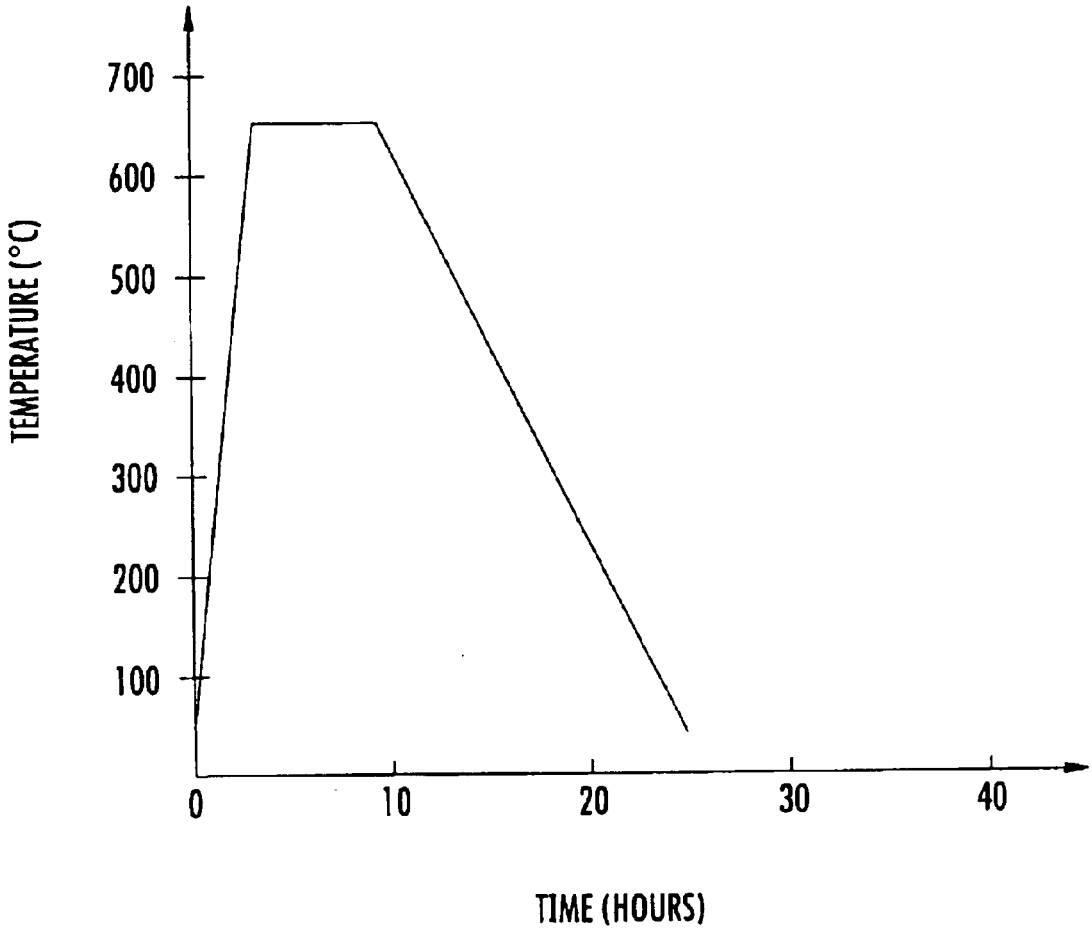
FIG. 5 is a graph illustrating in further detail the passivation step of FIG. 3.

Various steps in the above method will now be described in greater detail with reference to FIGS. 4 and 5. Again, the method begins (Block 40) with providing a suitable iron-silicon alloy powder, at Block 41, such as the melt sprayed powder from Hoeganaes or the powder formed by the diffusion/impact milling process noted above. The flakes may be formed by wet milling the iron-silicon alloy powder in the presence of a solvent, and more particularly, heptane, at Block 42.

Conventional diffusion reaction ferrous silicide is typically ground using an impact mill in conjunction with an air classifier. The air classifier separates the powder into two segments, course and fine. These, or the unmilled product from the atmosphere kiln, may be wet milled using the methods described above. An exemplary wet milling process may use equal parts of powder and heptane with a 3⁄16" stainless steel media. Of course, other suitable grinding media and quantities thereof may also be used. Moreover, in some embodiments a combination of dry grinding (i.e., by impact milling and/or ball milling in an attritor) and wet grinding in heptane may be used to reduce the amount of time required to produce the desired size reduction and flaking of the iron-silicon alloy powder.

When wet grinding is performed in the presence of a solvent, an optional step of removing the solvent (i.e., drying the flakes) may be performed, at Block 43. Such solvent removal is particularly appropriate when heptane is used as the solvent due to the volatile nature of this medium. By way of example, a batch vacuum dryer may be used for heptane removal.

The flakes may then be passivated, at Block 44, as follows. The flakes are loaded into refractory containers and passed through an annealing-passivation cycle, an exemplary embodiment of which is illustrated in the graph of FIG. 5. For example, about five pounds of flakes may be loaded into 10.5"×10.5" Corderite saggers and placed into a kiln, though other quantities of flakes, container types, etc., may be used. The flakes are then heated in an air ambient from a starting temperature (e.g., 25° C.) to a temperature less than about 700° C., and, more preferably, about 650° C.

In the illustrated example, this temperature ramp up is shown to take place over about four hours, but longer or shorter ramp ups may be used in different embodiments. Once the desired passivation temperature has been reached, the flakes are maintained at this temperature for about 24 hours or less, and, more preferably, for about four to six hours, as illustratively shown in FIG. 5. Of course, longer "soak" times may be used in some embodiments.

Thereafter, the particles are allowed to cool, e.g., to 25° C., over a period of about 18 hours (although longer or shorter cooling times may also be used), and the kiln car may be lowered at less than about 300° C. Of course, while linear temperature ramp ups and ramp downs have been illustratively shown, it will be appreciated by those of skill in the art that other suitable ramps (e.g., exponential, stepped ramps, etc.) may also be used.

The purpose of the passivation step is twofold. First, as briefly noted above, it is desirable to modify (to the extent possible) the low Curie temperature phases present in the powder by converting most of the $Fe_2Si$, $Fe_5Si_3$, and Fe therein to $Fe_3Si$ and FeSi. Secondly, since the passivation takes place in an air ambient, a protective film or layer of $SiO_2$ is formed over the bare iron-silicon alloy by migrating minute traces of silicon to the surface where it oxidizes in the ambient atmosphere.

In particular, as the starting iron-silicon alloy powder preferably includes less than about 25% silicon by weight, the passivated iron-silicon alloy flakes 15 may correspondingly also include less than about 25% silicon by weight. Furthermore, the temperature phases are preferably regulated such that the flakes include less than about 25% $Fe_5Si_3$by weight, and rather include greater than about 40% $Fe_3Si$ by weight and about 0.5–25% FeSi by weight.

Once passivated, the ferrous silicide flakes are removed from the kiln, they are then passed through a de-agglomerator and screened, at Blocks 45 and 46. The former step is desirable as some agglomeration takes place at the 650° C. temperature of the passivation kiln, and the screening allows the passivated flakes 15 having a desired size to be separated from the remainder of the flakes. In particular, the deagglomeration may be performed using a granulator with a 20 mesh barrel screen. Moreover, the flakes may be screened with a screen having openings of about 60 microns or less, for example, to provide the desired flake size and remove any undesirable particles from the refractory containers.

Stated otherwise, it is typically desirable that the flakes have a maximum dimension 17 (FIG. 2) of less than about 60 microns and, more preferably, about 3 to 20 microns, though other dimensions may also be used. The leftover flakes may then be re-screened, if desired, to increase yield. Of course, in some embodiments screening may be performed to separate flakes of a desired size prior to passivation, but some degree of deagglomeration/screening may still be desirable after passivation depending upon the given application.

Flakes having such dimensions can then be suspended in a carrier, at Block 47, for later application to the surface of a vehicle, for example, thus ending the method, at Block 48. By way of example, suitable carriers may include organic materials, dielectric materials (e.g., similar to paint, which can be atomized and sprayed on a vehicle), electrically conductive materials, magnetic materials, or a viscous elastomeric material which may be applied in panels. In this latter case the flake size may be made somewhat larger.

Also, in some embodiments passivated iron-silicon particles having different shapes may be included as well. In particular, in some applications it may be desirable to include not only passivated iron-silicon flakes in the coating but also passivated spherical particles. That is, a base powder with spherical particles may be milled without flaking using one of the above described techniques, passivated, and then deagglomerated and/or screened, as similarly described above. Air classification is an optional step that may be used in conjunction with the milling techniques to provide a desired particle size distribution, as noted above. The passivated spherical particles may then be suspended along with the passivated flakes in various ratios in the carrier to provide different EM absorbing properties (Block 47).

Figure 6:
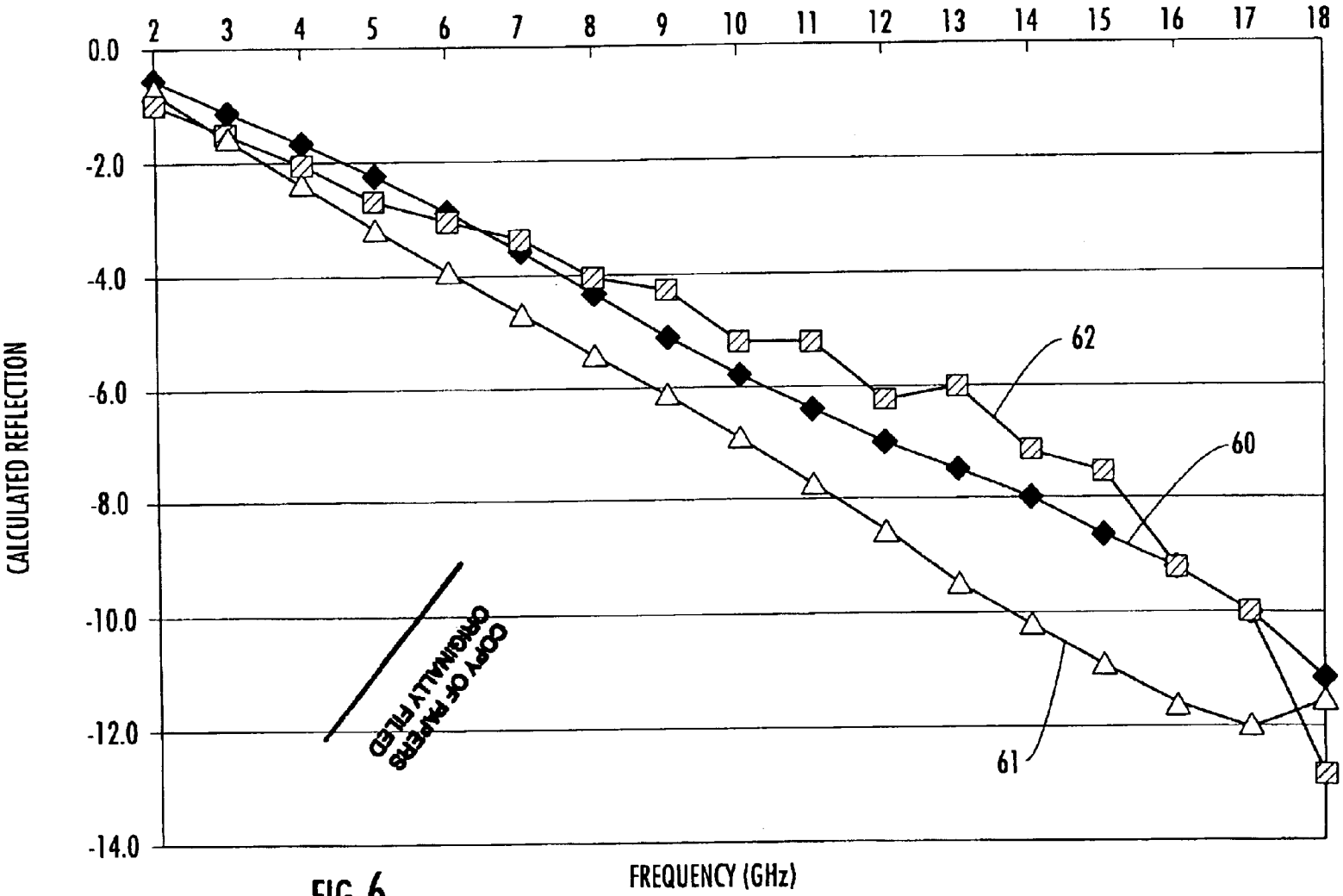
FIG. 6 is a graph illustrating calculated reflection vs. frequency for two RAM materials produced in accordance with the prior art and for a RAM material produced in accordance with the present invention.

By way of comparison, plots of calculated reflection vs. frequency are illustratively shown in FIG. 6 for two RAM materials manufactured in accordance with the prior art, and one plot for a RAM material produced in accordance with the present invention including only flaked particles. More particularly, the plot 60 is based upon a ferrous silicide material formed by a prior art diffusion process, the plot 61 is for a material based on carbonyl iron, and the plot 62 is for the RAM made in accordance with the invention. As may be seen, the reflective properties of the material made in accordance with the present invention are generally less than those of the other two materials across most of the illustrated frequency range.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims That which is claimed is:

1. A method for making a radiation absorbing material (RAM) coating comprising:

providing an iron-silicon alloy powder;

forming the iron-silicon alloy powder into flakes;

passivating the flakes;

selecting passivated flakes having a desired size; and combining the selected passivated flakes with a carrier to provide the RAM coating.

2. The method of claim 1 wherein the iron-silicon alloy powder comprises melt sprayed iron-silicon alloy powder.

3. The method of claim 1 wherein the iron-silicon alloy powder comprises diffused iron-silicon alloy powder.

4. The method of claim 1 wherein forming comprises impact milling the iron-silicon alloy powder.

5. The method of claim 1 wherein forming comprises grinding the iron-silicon alloy powder using a dry attritor.

6. The method of claim 1 wherein forming comprises wet milling the iron-silicon alloy powder in the presence of a solvent.

7. The method of claim 6 wherein the solvent comprises heptane.

8. The method of claim 6 further comprising removing solvent prior to passivating.

9. The method of claim 1 wherein selecting comprises:

deagglomerating the passivated alloy flakes; and screening the deagglomerated flakes to obtain flakes having the desired size.

10. The method of claim 1 wherein the desired size is a maximum dimension of less than about 60 microns.

11. The method of claim 1 wherein passivating comprises exposing the flakes to an oxygen containing ambient at a temperature of less than about 700° C.

12. The method of claim 1 wherein passivating comprises passivating the flakes for less than about 24 hours.

13. The method of claim 1 wherein the carrier comprises at least one of an organic material, a dielectric material, an electrically conductive material, a magnetic material, and an elastomeric material.

14. The method of claim 1 wherein the iron-silicon alloy powder comprises less than about 25% silicon by weight.

15. The method of claim 1 wherein combining comprises combining the selected passivated flakes and passivated, generally spherical iron-silicon alloy particles with the carrier to provide the RAM coating.

16. A method for making a radiation absorbing material (RAM) coating comprising:

providing an iron-silicon alloy powder;

wet grinding the iron-silicon alloy powder into flakes in the presence of a solvent;

passivating the flakes;

deagglomerating the passivated alloy flakes;

screening the deagglomerated flakes to obtain flakes having a desired size; and combining the screened passivated flakes with a carrier to provide the RAM coating.

17. The method of claim 16 wherein the iron-silicon alloy powder comprises melt sprayed iron-silicon alloy powder.

18. The method of claim 16 wherein the solvent comprises heptane.

19. The method of claim 16 further comprising removing solvent prior to passivating.

20. The method of claim 16 wherein the desired size is a maximum dimension of less than about 60 microns.

21. The method of claim 16 wherein passivating comprises exposing the flakes to an oxygen containing ambient at a temperature of less than about 700° C.

22. The method of claim 16 wherein passivating comprises passivating the flakes for less than about 24 hours.

23. The method of claim 16 wherein the carrier comprises at least one of an organic material, a dielectric material, an electrically conductive material, a magnetic material, and an elastomeric material.

24. A method for making a radiation absorbing material (RAM) comprising:

providing an iron-silicon alloy powder;

forming the iron-silicon alloy powder into flakes;

passivating the flakes; and selecting passivated flakes having a desired size.

25. The method of claim 24 wherein the iron-silicon alloy powder comprises melt sprayed iron-silicon alloy powder.

26. The method of claim 24 wherein forming comprises impact milling the iron-silicon alloy powder.

27. The method of claim 24 wherein forming comprises grinding the iron-silicon alloy powder using a dry attritor.

28. The method of claim 24 wherein forming comprises wet milling the iron-silicon alloy powder in the presence of a solvent.

29. The method of claim 28 wherein the solvent comprises heptane.

30. The method of claim 28 further comprising removing solvent prior to passivating.

31. The method of claim 24 wherein selecting comprises:

deagglomerating the passivated alloy flakes; and screening the deagglomerated flakes to obtain flakes having the desired size.

32. The method of claim 24 wherein the desired size is a maximum dimension of less than about 60 microns.

33. The method of claim 24 wherein passivating comprises exposing the flakes to an oxygen containing ambient at a temperature of less than about 700° C.

34. The method of claim 24 wherein passivating comprises passivating the flakes for less than about 24 hours.

* * * * *

UNITED STATES PATENT AND TRADEMARK OFFICE

CERTIFICATE OF CORRECTION

PATENT NO. : 6,890,971 B2
APPLICATION NO. : 10/189654
DATED : May 10, 2005
INVENTOR(S) : Henry G. Paris, Danny R. Smith and Scott F. Smith It is certified that error appears in the above-identified patent and that said Letters Patent is hereby corrected as shown below:

Title page (56)

(Other Publications)

Insert: -- Walser et al., Fabrication and Properties of Microforged Ferromagnetic Nanoflaker, IEEE Transactions on Magnetics, Vol. 34, No. 4, July 1998, pgs. 1144-1146 --

Column 4, Line 32

Delete: "the a or"

Insert: -- the α or --

Signed and Sealed this

Fourth Day of September, 2007

JON W. DUDAS
*Director of the United States Patent and Trademark Office*